United States Patent [19]

Gossler et al.

[11] Patent Number: 4,880,141

[45] Date of Patent: Nov. 14, 1989

[54] PALLETS SUPPORTED REINFORCED CONTAINER

[76] Inventors: Hans K. Gossler, 9535 Walnut Dr.; Chester K. Guynn, 7406 N. Hawthorne La., both of Munster, Ind. 46321

[21] Appl. No.: 321,679

[22] Filed: Mar. 10, 1989

[51] Int. Cl.[4] ..... B65D 19/20

[52] U.S. Cl. ..... 220/464; 206/600; 220/415; 229/23 A; 229/23 R

[58] Field of Search ..... 220/415, 464, 468; 229/23 R, 41 R, 41 B, 41 C, 23 A; 206/386, 600

[56] References Cited

U.S. PATENT DOCUMENTS

| | | | |
|---|---|---|---|
| 1,770,348 | 7/1930 | Bliss | 229/41 R |
| 2,606,709 | 8/1952 | Carey et al. | 229/23 R |
| 4,341,337 | 7/1982 | Beach, Jr. et al. | 229/41 C |
| 4,383,609 | 5/1983 | Lochmiller | 229/23 R |
| 4,682,708 | 7/1987 | Pool | 220/468 |

FOREIGN PATENT DOCUMENTS

| | | | |
|---|---|---|---|
| 375944 | 10/1939 | Italy | 229/23 A |

*Primary Examiner*—Gary Elkins
*Attorney, Agent, or Firm*—Arthur L. Nelson

[57] ABSTRACT

A lightweight container mounted on a pallet which can be easily assembled and disassembled without any tools and which has structural integrity to hold its shape when filled with a loose material.

12 Claims, 2 Drawing Sheets

PALLETS SUPPORTED REINFORCED CONTAINER

This invention relates to containers, and more particularly to a cardboard box or similar material which is fluid tight and is supported on a pallet which can be easily assembled or disassembled. The container when disassembled requires a minimum of space for storage.

In the transporting and storage of loose material such as fungible material it is desirable to have a container which can be readily assembled and filled with material. The container must retain its shape and provide a means of storing the material or transporting the material in the assembled container. To be able to store the material or to readily transport it, its desirable to be able to readily move the container. To accomplish this, containers have been provided with underlying pallets for spacing the contents supporting deck of the container from the ground to enable the tines of a fork lift truck to enter below the deck, for raising and transporting and lowering the container. One disadvantage of a container may be that they do not always have a sufficiently sturdy construction to support the loads contained during transportation and storage. Another disadvantage of the containers of this type has been that when they have been emptied, they require an uneconomical amount of space during storage or reshipment back to the site of refilling. Prior containers have also commonly been unduly heavy and expensive and consequently burdensome in their use.

The Williams patent, U.S. Pat. No. 4,085,846 shows a cardboard box which is fastened to a pallet. The pallet has two flaps on its deck which are foldable to fasten to the bottom of the box. The box is not collapsible to conserve space and storage.

Similarly, the Breton patent, U.S. Pat. No. 2,902,199 shows a cardboard box which is adapted for being positioned on a pallet. The means of fastening the box to the pallet is by use of two flaps which extend into the box and must be fastened by some suitable fastening means. This cardboard box is not collapsible either and accordingly it is believed that the applicants invention is distinguishable over this reference as well.

The applicants invention provides for a pallet in which a floor consisting of two panels of card-board or similar material positioned normal to each other which are fastened to the deck of the pallet. Each of the floor pieces includes foldable end flaps which can be folded vertically and then embraced by a tubular member. Reinforced side wall panels are inserted inside of the end flaps to provide stiffness and structural integrity of the box per se. A plastic bag is inserted inside the container to provide a fluid tight chamber and then a cover is placed over the top to close the container off. Also, end flaps on the tubular member are provided to partially close the chamber on the top side. Accordingly, it is believed this structure is distinguishable from that shown in the two references sited. Also, the applicants invention is adapted to be disassembled or collapsed and stacked on the pallet to require a minimum of space. This is not provided by the two references sited.

It is an object of this invention to provide a pallet supported, reinforced, light weight container for handling granular or liquid material.

It is another object of this invention to provide a pallet supported, reinforced, light weight liquid tight container for carrying material and collapsible to require a minimum of space when returned for refilling or storage.

It is a further object of this invention to provide a collapsible, pallet supported, fluid tight container for carrying fungible material and collapsible to require a minimum of space for transportation to refill and storage.

The objects of this invention are accomplished by a pallet supported container including: two floor boards the size of the pallet with end flaps positioned normal to each other and fastened to the pallet. The end flaps extend vertically to form four continuous sidewalls when assembled and lie flat on the floor boards when disassembled. The vertically oriented flaps in the assembled position are surrounded by a rectangular, tubular member with flaps, reinforced by four interlocking flat panels of a heavier construction. A plastic bag lines the inner chamber to retain material in the container. A flat cover plate is placed on the container to seal off the chamber in the container. The four flaps formed by the top edges of the tubular member, also fold over to partially close the upper side of the container. For additional closure, two bands may be applied criss-cross, midway vertically around the container to close the chamber.

Referring to the drawings, the preferred embodiment is illustrated.

Figure 1:
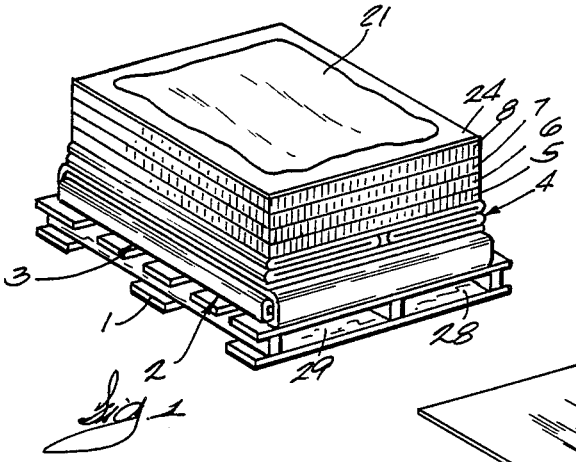
FIG. 1, illustrates the container in the collapsed and disassembled position mounted on the pallet.

Referring to the drawings, FIG. 1 illustrates the pallet 1, supporting the assembly of components for the container. The assembly consists essentially of the two floor boards 2 and 3 and the tubular member 4. The reinforced panels 5, 6, 7 and 8 are also shown and the top 24 is supported with the bag 10 in the stacked assembly of the various parts in the assembly.

Figure 2:
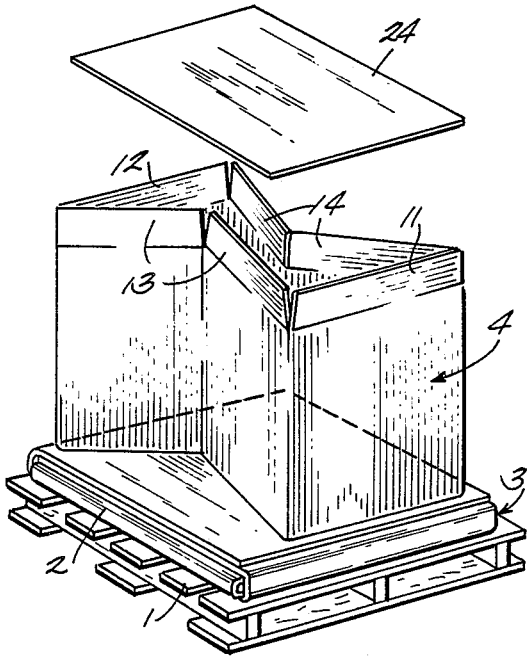
FIG. 2, illustrates a partial assembly of the container with the tubular member supported on top of the two floor boards folded in the collapsed position.

FIG. 2, illustrates the pallet 1, supporting the floor boards 2 and 3. The tubular member 4 is partially folded and in the upright position. The tubular member 4 includes four flaps 11,12, 13 and 14.

Figure 3:
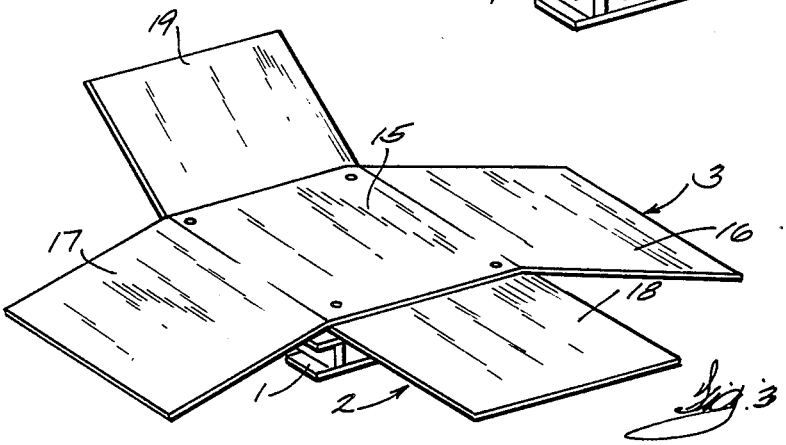
FIG. 3, illustrates the two floor boards assembled on the pallet with the two end flaps of each of the floor boards in an extended position.

FIG. 3, illustrates the floor boards 2 and 3 mounted on the pallet 1. The floor boards are fastened by suitable means to the pallet such as stapling or nailing or use of some adhesive to maintain the fixed relationship between the floor boards and the pallet. The floor board 3 includes the floor 15 and two end flaps 16 and 17. The floor board 2 includes a floor similar to that of 15 immediately below the floor 15 and the end flaps 18 and 19. The end flaps are in a horizontal position over the floor portion of the floor boards in the disassembled and the flaps are positioned vertically in the assembled position.

Figure 5:
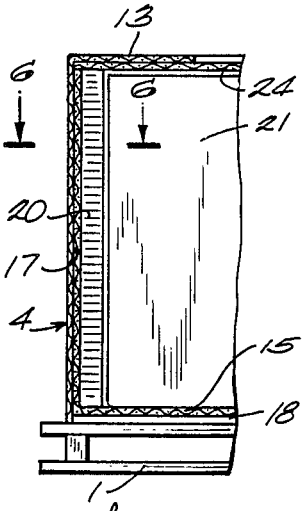
FIG. 5, illustrates a cross-section view taken on line 5—5 of FIG. 4.
Figure 6:
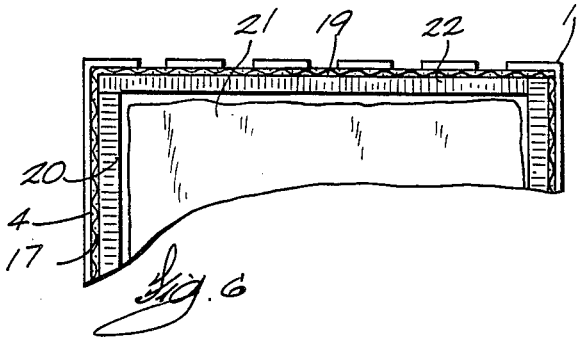
FIG. 6, illustrates a cross-section view taken on line 6—6 in FIG. 5.

FIGS. 5 and 6 show cross-section views of the container. The pallet 1 supports the assembly including the floor panels 15 and 18. The end flap 17 is in the vertical position and the tubular member 4 is engaging the outer portion of the flap 17. The flap 13 is shown in the closed position. The reinforced panel 5 is positioned inside of the flap 17 and the bag 21 is inside of the panel 5. The reinforced panels 5 and 6 are shown in the fixed position in FIG. 6.

The cover 24 is shown positioned in the container immediately underneath the four flaps of the tubular member in FIG. 5. The cover is also shown in position in FIG. 4 as well.

Figure 4:
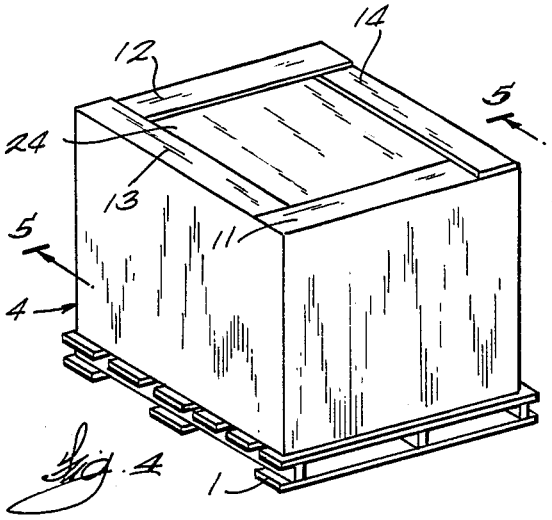
FIG. 4, illustrates the assembled position of the components on the pallet.

FIG. 4 shows the tubular member 4 in position embracing the end flaps of the floor boards which are not shown in the view. The top 24 retains the bag 21 in the chamber inside the container to form the chamber 26.

The container is shown in the assembled position in FIG. 4 and the disassembled position in FIG. 1. In the disassembled position shown on FIG. 1, the floor boards 3 and 4 are positioned with the end flaps 18 and 19 folded to a horizontal position over the floor boards and the end flaps 16 and 17 folded to a horizontal position over the floor portion. In the collapsed position of the tubular member 4, it collapses to a position in which it lies horizontally over the floor boards and does not extend beyond the peripheral edges of the pallet 1. Similarly the four reinforced panels 5,6,7, and 8 are positioned immediately above the tubular member and they fit or conform to the size of the pallet. Similarly the bag 21 and the top 24 lie on top of the reinforced panels to form a compact arrangement requiring a minimum space for storage or reshipment or refilling of the container.

In the assembled position, the floor boards 15 and 18 are fastened to each other and the end flaps 16 and 17 as well as the end flaps 18 and 19 are positioned in a vertical position. The tubular member 4 embraces the end flaps with a partial interference to ensure structural integrity of the side walls. The reinforced panels 5,6,7 and 8 are interlocked and positioned immediately inside of the end flaps of the floor boards. These panels are relatively stiff and do not deform when the container is filled. Likewise, the bag is inserted in the chamber formed by the interlocking panels and can be filled with a liquid or a fungible material which does not require any stiffness to maintain the structural integrity of the container. Accordingly, the bag is filled and closed, and then the top 24 is positioned over the bag. The flaps 11, 12, 13 and 14 are then folded and interlocked in position and the container is in the assembled position containing what ever material is to be stored or transported in the container. The fork lift can conveniently carry the pallet by extending the tines of the fork lift in the openings 28 and 29 immediately underneath the upper deck of the pallet.

The embodiments of the invention in which an exclusive property or privilege is claimed are defined as follows:

1. A container assembly comprising, a rigid pallet base, a first floor board fastened to and covering floor of said pallet and end flaps foldable to a vertical position, a second floor board positioned normal to and fastened to and covering said first floor board with end flaps foldable to a vertical position to form continuous side walls with said first end flaps around said floor of said pallet, a tubular member having a rectangular cross-section positioned around said vertically oriented end flaps forming double thickness walls, four interlocked reinforced panels positioned inside the said end flaps forming reinforced side walls, a fluid tight bag received inside said side panels to form a fluid tight chamber in said container, a flat cover received in the top of said container, foldable flaps on the top of said tubular member foldable to hold the top in place.

2. A container assembly as set forth in claim 1 wherein said end flaps fold onto the floor board in the disassembled position.

3. A container assembly as set forth in claim 1 wherein the floor board end flaps extend a lessor height than said tubular member.

4. A container assembly as set forth in claim 1 wherein said tubular member forms an interference fit with the outer surface of said vertically oriented flaps to provide structural integrity.

5. A container assembly as set forth in claim 1 wherein the peripheral edge of said tubular member contacts a deck surface of said pallet.

6. A container assembly as set forth in claim 1 wherein said bag comprises a plastic bag of fluid tight characteristic.

7. A container assembly comprising a rigid pallet base, a first floor board fastened to and covering said pallet and having end flaps foldable between a horizontal and vertical position, a second floor board positioned normal to said first floor board and fastened to and covering said first floor board with end flaps foldable between vertical and horizontal positions, a tubular member for embracing said end flaps of said vertically positioned end flaps and collapsible for lying in the horizontal position on said floor boards in a disassembled position, four reinforced panels forming inner side walls of said container and for positioning horizontally on said tubular member in the disassembled position, a bag for holding material in said container and lying flat on said reinforced panels in the disassembled position, a cover plate covering said container in the assembled position and lying horizontally on said bag when disassembled in the collapsed position.

8. A container assembly as set forth in claim 1 including end flaps on the upper end of said tubular member.

9. A container assembly as set forth in claim 1 including interlocking means on the ends of said reinforced panels to provide structural integrity.

10. A container assembly comprising, a rigid pallet base comprising, a first floor board fastened and covering said pallet and having end flaps foldable to a vertical position, a second floor board positioned normal to said first floor board and fastened to and covering said first floor board and having end flaps foldable to a vertical position, a collapsible tubular member for embracing said end flaps when said flaps are in the vertical position, reinforced side panels having interlocking means for positioning within said and flaps when said end flaps are in the vertical position, a bag received within said container to provide a sealed chamber in said container, a cover plate to enclosed said chamber received in the top of said container.

11. A container assembly as set forth in claim 10 wherein said end flaps on said floor boards fold onto the floor board in the disassembled positioned.

12. A container assembly as set forth in claim 10 wherein said container includes cardboard construction of said floor boards and tubular member.

* * * * *